United States Patent [19]

Urban et al.

[11] 4,135,343

[45] Jan. 23, 1979

[54] METHOD AND APPARATUS FOR FRAMING PHOTOGRAPHIC FILM SECTIONS IN SLIDE FRAMES

[75] Inventors: Otfried Urban; Peter Mundt, both of Garmisch-Partenkirchen; Arnold Neuhold, Farchant, all of Fed. Rep. of Germany

[73] Assignee: Geimuplast Peter Mundt KG, Farchant, Fed. Rep. of Germany

[21] Appl. No.: 719,529

[22] Filed: Sep. 1, 1976

[30] Foreign Application Priority Data

Sep. 3, 1975 [DE] Fed. Rep. of Germany ..... 2539199

[51] Int. Cl.[2] ..... B65B 17/00; B65B 63/00

[52] U.S. Cl. ..... 53/435; 53/520; 156/108; 156/514

[58] Field of Search ..... 156/108, 252, 293, 264, 156/514, 552, 556, 423, 201; 53/123, 23, 266 A, 255, 50, 381 R; 40/158 B, 159; 206/194; 270/58, 57; 271/248, 240, 250; 178/836, 373

[56] References Cited

U.S. PATENT DOCUMENTS

| | | | |
|---|---|---|---|
| 2,804,961 | 9/1957 | Carter | 156/DIG. 127 |
| 3,350,091 | 10/1967 | Masterson et al. | 271/240 |
| 3,457,697 | 7/1969 | Engelstein | 53/123 |
| 3,521,423 | 7/1970 | Koeppe et al. | 53/23 |
| 3,524,299 | 8/1970 | Mundt et al. | 53/123 |
| 3,679,522 | 7/1972 | Anderegs et al. | 156/477 R |
| 3,807,121 | 4/1974 | Mundt et al. | 53/123 |
| 3,896,603 | 7/1975 | Nout | 53/123 |
| 3,944,461 | 3/1976 | Ogron | 156/538 |

FOREIGN PATENT DOCUMENTS 2209406 10/1973 Fed. Rep. of Germany ..... 40/158 B

*Primary Examiner*—Douglas J. Drummond
*Assistant Examiner*—Michael W. Ball
*Attorney, Agent, or Firm*—Fleit & Jacobson

[57] ABSTRACT

In a method of severing developed photographic film strips into film sections at a severing station and immediately mounting same in slide frames which are spread open ready to receive them and which are conveyed away from the severing station, each severed film section is guided along an edge which is oblique with respect to the conveying direction of the slide frames. An apparatus for performing this method comprises severing means for the strip, a guide path for the slide frames and a guide rail with an oblique guide edge arranged downstream of the severing means to present a leading guide edge portion which extends into the gap between the spread-open slide frame portions.

5 Claims, 3 Drawing Figures

Fig. 1
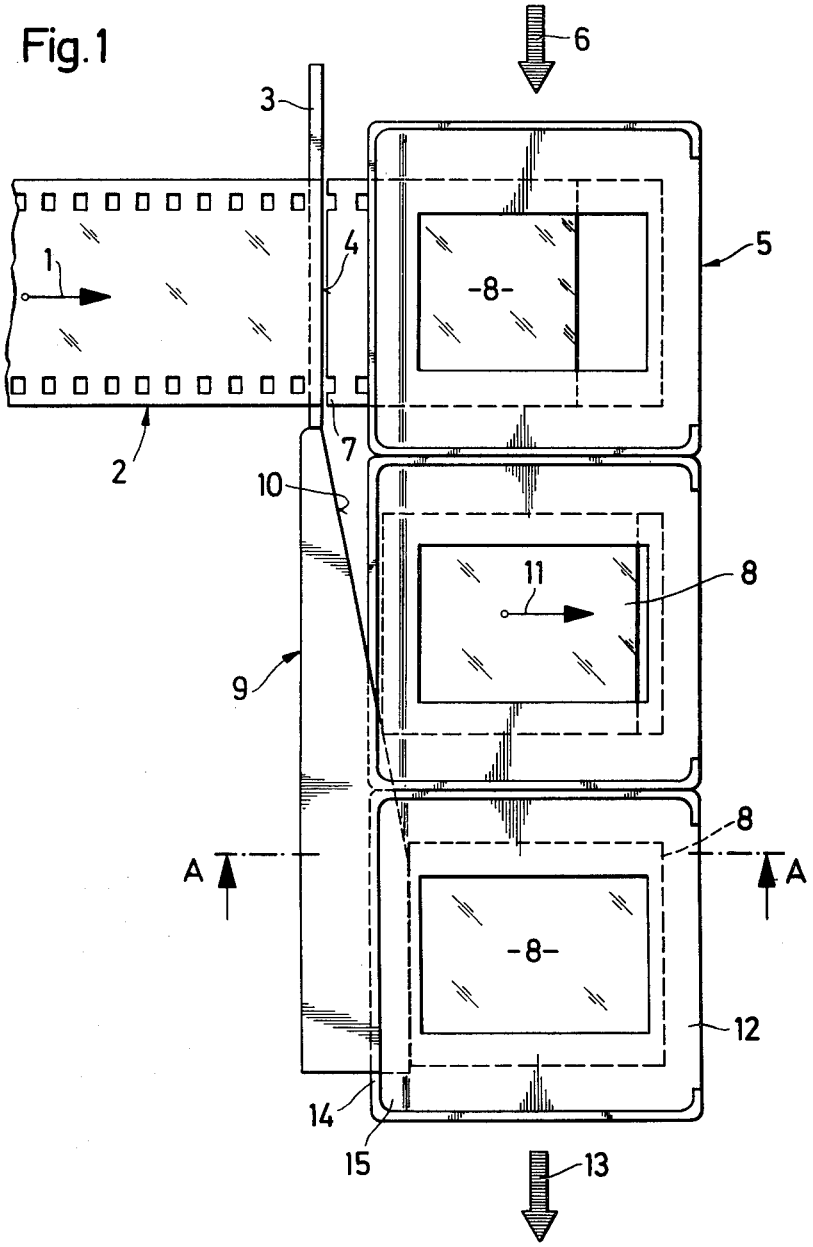
Fig. 2(A-A)
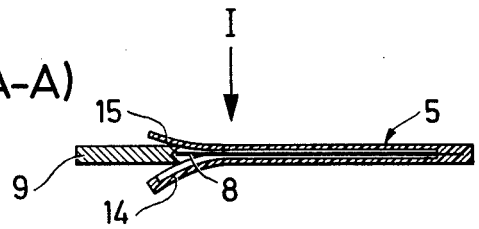

METHOD AND APPARATUS FOR FRAMING PHOTOGRAPHIC FILM SECTIONS IN SLIDE FRAMES

The invention relates to a method of severing developed film strips into film sections and immediately thereafter mounting same in slide frames which are spread open ready to receive them.

Such a method is known from German Pat. No. DT-PS 1,285,765. In the known method, the slide frame is spread open at the severing station on the one hand and, on the other hand, the slide is fully introduced in the frame until it is disposed in the projection position.

German Pat. No. DT-PS 1,918,970 discloses a machine for severing developed film strips into film sections and for the immediately subsequent framing thereof in a slide frame comprising a base portion and a cover portion. The film is intermittently fed in a substantially C-shaped guide path of a severing apparatus for severing the leading film section from the strip. The film section severed thereby is engaged at both longitudinal edges by movable holding means and introduced to the interior of a frame which is folded open ready to receive same, whereupon the film section is retained in the frame by pressing down the cover portion of the slide frame onto the frame portion. Two parallel cutting elements spaced apart by the length of the film section, preferably scissors, are provided. In the space between these cutting elements, there are gripping tongs which engage the severed film section at its trailing longitudinal edge as viewed in the direction of introduction and are moved in a plane substantially parallel to the plane of the film strip so that they will insert the film section into the opened frame at a slight inclination to the base portion of the frame up to its final position. Before the gripping tongs are moved back, they are opened to release the film section, so that the latter will reliably remain in its predetermined position between the base portion and the cover portion which returns to the closed position.

It is the underlying object of the invention to provide a simpler and faster method of the aforementioned kind.

This is achieved by the invention in that the severed film section is guided along an edge which is oblique with respect to the conveying direction of the slide frames. This has the advantage that the film section severed from the film strip is also automatically moved at right angles to the direction in which it is being conveyed, until it has reached the projection position in the slide frame. Since a frame is spread or folded open in readiness, the severed film section is protected against becoming scratched even if, for the purpose of avoiding separate continued conveying of the film strip and slide frame, the severed film section is partially inserted in the slide frame and then moved along together with the frame. Another advantage is that the method of the invention permits considerable simplification of the apparatus for performing it.

The apparatus for performing the method of the invention is characterised by severing means for the strip of photographic film and a guide path for the slide frames and is an oblique guide rail arranged downstream of the severing means as viewed in the conveying direction of the film strip and having a rear section (as viewed in the conveying direction) which extends into the gap between the spread-open slide frame portions. This has the advantage that the guide rail serves to keep the spread-open or folded-open frame in this partially open position until the severed film section has reached its final position in the slide frame, i.e. its projection position.

An embodiment of the invention will now be described by way of example with reference to the drawing, wherein:

FIG. 1 is a diagrammatic plan view of an apparatus for performing the method of the invention;

FIG. 2 is a section on the line A—A in FIG. 2, and

Figure 3:
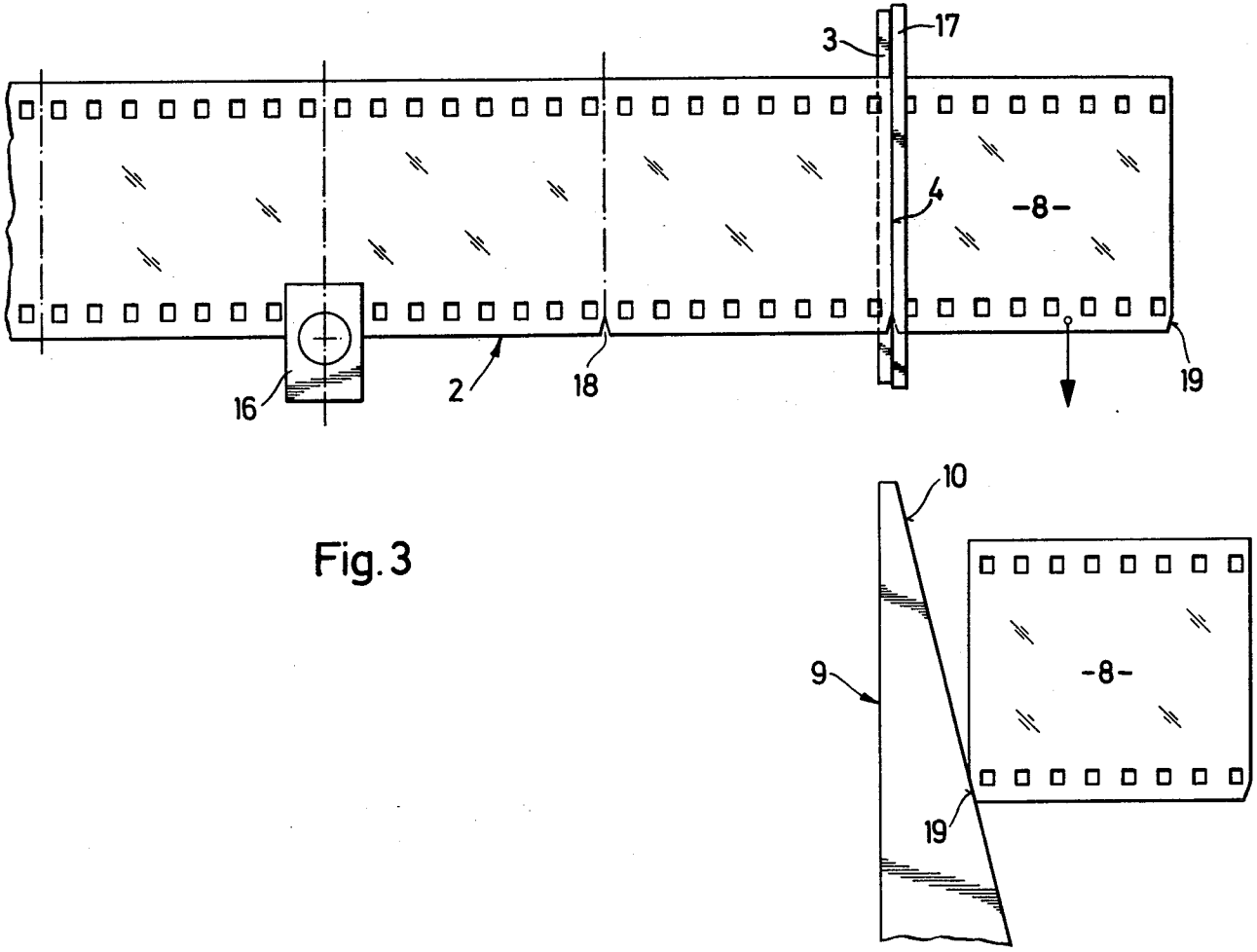
FIG. 3 is a diagrammatic view of a modified embodiment of the FIG. 1 apparatus.

The method according to the invention will become evident from the following description of the operation of the apparatus illustrated in the drawing. A film strip 2 is intermittently fed to a severing station in the direction of the arrow 1. At the severing station, there are severing means comprising an upper knife 17 and a lower knife 3. At the severing station, a film section 8 is cut from the film strip 2. In the illustrated example, this is performed in a manner such that the film strip 2 has already been partially inserted within the slide frame 5.

The slide frame 5 together with the partially inserted film section 8 is subsequently conveyed in the direction of the arrow 6, namely in the illustrated example perpendicular to the feeding direction of the film strip 2. During this continued conveying, the severed film section 8 is guided along a guide rail 9 which is oblique with respect to the conveying direction of the slide frame 5. The corner 7 of the film section 8 initially still slides along the lower knife 3 and then reaches the guide rail 9, along the oblique front edge 10 of which it slides. During this conveying motion of the severed film section 8 along the guide rail 9, it is displaced in the direction of the arrow 11 further into the frame 5. The angle of the oblique guide edge 10 of the rail 9 is selected to ensure that the film section 8 does not become twisted as it is being pushed in.

In an advantageous embodiment of the apparatus for performing the method according to the invention, the guide rail 9 has an inwardly notched shape, as indicated in FIG. 2. This has the advantage that the corner 7 of the film section 8 is prevented from becoming deflected upwardly or downwardly.

In the preferred apparatus illustrated in FIG. 1 for performing the method of the invention, the rear portion of the guide rail 9, as viewed in the conveying direction, projects into the gap between the spread-open or folded-open frame portions 14, 15 as will be evident from FIGS. 1 and 2. As the severed film section 8 is being conveyed out of the severing station, the guide rail 9 thus reaches between the base portion 14 and cover portion 15 of the frame. Continued conveying of the severed film section 8 out of the severing station thus leads to the guide bar 9 being able to fulfil a double function. On the one hand, it holds the frame portions 14, 15 in the open condition and on the other hand it pushes the severed film section 8 into its final position of use in the slide frame 5, i.e. into the projection position.

When the slide frame 5 has reached the position 12 indicated in FIG. 1, insertion of the severed film section 8 in the slide frame 5 has been completed. The slide frame 5 is then ejected from the apparatus in the direction of the arrow 13 in a finally framed condition. The base portion 14 and cover 15 of the slide frame 5, which had been flexed apart by suitable spreading bars spring back to their original planar position after leaving the station 12 and retain the severed film section 8. This is possible because the slide frame is made from a suitable plastics material.

To guard against even the possibility of the sharp edge 7 of the severed film section leading to disruption during insertion thereof, which, however, has never occurred during practical tests, an advantageous embodiment of the method of the invention provides for removing a wedge-shaped film section 18 from a marginal portion of the film strip 2. For this purpose, the apparatus for carrying out the method of the invention makes provision, as shown in FIG. 3, for stamping-out equipment 16 in the region of the feed path of the film strip 2, the equipment being disposed at a spacing from the cutting edge of the lower knife 3 and upper knife 17 equal to the distance of each film step or a multiple thereof. The stamper removes a wedge-shaped piece 18 from the margin of the film strip so that, after severing along the cutting line 4, the edge that is sharp cornered at 7 in FIG. 1 has a bevelled portion 19. This facilitates sliding along the front edge 10 of the guide rail 9.

The method of the invention could also be carried out in an apparatus modified from the illustrated example, in which the film strip 2 on the one hand and the slide frame 5 on the other hand are conveyed along parallel paths in a conventional manner. Again, in this modified embodiment the severed film section will be guided along a guide rail that is oblique to the conveying direction for the slide frames.

The apparatus for carrying out the method of the invention is further characterised in that a spreading bar is provided for each of the base portion 14 and cover portion 15 of the slide frames 5, such spreading bars being arranged to start upstream of the severing station.

We claim:

1. A method of mounting film sections in slide frames consisting of superposed interconnected frame portions which can be flexed apart, comprising the steps of bringing said slide frames successively to a film-severing station and flexing said frame portions apart to define an opening at one edge thereof, intermittently advancing a film to said severing station until the leading end of said film is partially inserted in said frame through said edge opening, severing a film section from said leading end along a line of cut disposed so that a portion of said severed section remains protruding from said frame through said edge opening, feeding said frame with partially inserted film section in a direction away from said severing station towards a stationary guide having a cam surface extending obliquely with respect to said frame feeding direction, continuing said feeding of said frame so that a corner of said protruding film section portion engages said cam surface and rides therealong, causing said cam surface to extend into said opening of said frame, whereby said protruding film section portion is progressively pushed at right-angles to said frame feeding direction through said edge opening into said frame during continued feeding thereof, and allowing said frame portions to flex together again after said film section has been fully inserted past said edge opening.

2. The method defined in claim 1, comprising the further step of stamping V-shaped notches out of an edge of said film at selected intervals prior to said severing step, and selecting said intervals such that each said line of cut is in registry with one said V-shaped notch, thereby bevelling said cam-engaging corner of each said severed film section.

3. Apparatus for mounting film sections in slide frames consisting of superposed interconnected frame portions which can be flexed apart, comprising means for bringing said slide frames successively to a film-severing station, means effective to flex said frame portions apart to define an opening at one edge thereof, means for intermittently advancing a film to said severing station until the leading end of said film is partially inserted in said frame through said edge opening, means for severing a film section from said leading end along a line of cut disposed so that a portion of said severed section remains protruding from said frame through said edge opening, means for feeding said frame with partially inserted film section in a direction away from said severing station towards a stationary guide, said guide comprising a cam surface which extends obliquely with respect to said frame feeding direction and has a trailing cam surface portion projecting into the feed path of said frame, whereby a corner of said protruding film section portion engages said cam surface and rides therealong, said trailing cam surface portion being disposed so as to enter between said slide frame portions.

4. The apparatus defined in claim 3, wherein said oblique cam surface is grooved to guide said corner of said protruding film section therealong.

5. The apparatus defined in claim 3, including notching means disposed upstream of said severing station and effective to notch said film at intervals along an edge thereof.

* * * * *